US005801129A

United States Patent [19]

Damm

[11] Patent Number: 5,801,129

[45] Date of Patent: Sep. 1, 1998

[54] PROCESS AND DEVICE FOR APPLYING A LUBRICANT CARRIER LAYER TO A WIRE MATERIAL TO BE FORMED IN A DRAWING PROCESS

[75] Inventor: Hubertus Damm, Herdecke, Germany

[73] Assignee: Firma August Neuhoff, Schwelm, Germany

[21] Appl. No.: 491,947

[22] PCT Filed: Oct. 19, 1994

[86] PCT No.: PCT/EP94/03433

§ 371 Date: Aug. 25, 1995

§ 102(e) Date: Aug. 25, 1995

[87] PCT Pub. No.: WO95/11096

PCT Pub. Date: Apr. 27, 1995

[30] Foreign Application Priority Data

Oct. 23, 1993 [DE] Germany ..... 43 36 220.6

[51] Int. Cl.[6] ..... C10M 125/00; B21C 9/00

[52] U.S. Cl. ..... 508/175; 508/165; 508/178; 508/180; 72/40; 72/41; 72/42

[58] Field of Search ..... 252/18; 508/175, 508/165, 178, 180

[56] References Cited

U.S. PATENT DOCUMENTS

| | | | |
|---|---|---|---|
| 2,703,550 | 3/1955 | Bell | 118/72 |
| 2,736,699 | 2/1956 | Carhart | 252/18 |
| 3,024,193 | 3/1962 | Gaynor et al. | 252/18 |
| 3,047,496 | 7/1962 | Rogers et al. | 252/18 |
| 4,404,828 | 9/1983 | Blachford | 72/42 |
| 4,545,227 | 10/1985 | Sudoh et al. | 72/12 |
| 4,553,416 | 11/1985 | Sudoh et al. | 72/40 |
| 4,688,411 | 8/1987 | Hagita et al. | 72/42 |
| 4,808,245 | 2/1989 | Nishi et al. | 72/42 |
| 5,201,206 | 4/1993 | Russo | 72/42 |
| 5,209,092 | 5/1993 | Russo | 72/41 |

FOREIGN PATENT DOCUMENTS 57-044698 3/1982 Japan .

*Primary Examiner*—Ellen M. McAvoy
*Attorney, Agent, or Firm*—Jones & Askew

[57] ABSTRACT

The invention concerns a method and device for applying a lubricant-carrier layer to the surface of a material which is to be cold-formed, in particular wire material (1) which is subsequently to be cold-drawn, the carrier layer being such that a lubricant can be applied over it. The material used to produce the layer is applied dry. A container is provided to hold a multiplicity of loose pressure-application elements plus a given quantity of the dry carrier-layer material. To produce the lubricant-carrier layer on the wire material, at least part of which is located at any given time inside the container, the pressure-application elements surrounding the wire material are caused to execute a motion such that they apply the carrier-layer material disposed between them to the surface of the wire material mechanically, the pressure-application elements making uniform contact with the surface of the wire material as they move relative to the surface.

19 Claims, 2 Drawing Sheets

Figure 1:
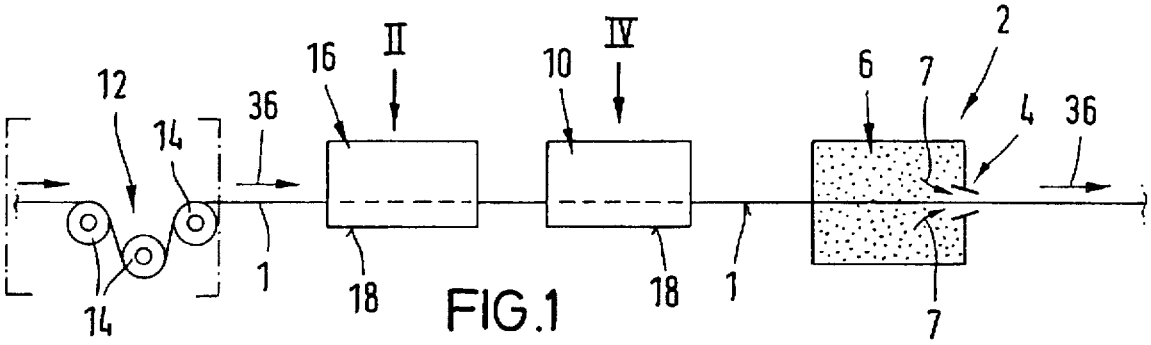

PROCESS AND DEVICE FOR APPLYING A LUBRICANT CARRIER LAYER TO A WIRE MATERIAL TO BE FORMED IN A DRAWING PROCESS

The present invention pertains to a process for applying a surface lubricant carrier layer to a material to be subsequently formed in a cold forming process, particularly to a wire material to be formed in a drawing process, where a solid lubricant can be subsequently applied to the lubricant carrier layer.

The invention further pertains to a special device for conducting this process, as well as to a novel material for application in the process of the invention, that is, for forming the lubricant carrier layer.

In cold forming processes, such as wire drawing but also tube drawing, deep-drawing and cold rolling, the application of a separating lubricant between material to be processed (the workpiece) and the respective tool is conventionally known (cf. Lueger, Lexicon of Technology, vol. 8, pp. 545–547, for instance). For this purpose, the raw material, usually preshaped by hot forming, particularly rolling, is first descaled, that is, an oxide layer formed on the material (especially an oxide layer formed in hot rolling, but rust as well) is removed in order to obtain a bare metal surface (cf. Lueger, vol. 5, p. 183). For wire, a multiple bending process is generally applied for descaling, with the wire being led around multiple deflection rolls, which disadvantageously leads to an undefined deformation (elongation) which was actually supposed to occur in a defined manner in the subsequent drawing processes. For a complete removal of oxide without residue, a pickling process has also been necessary thus far. For this pickling, the material, in a state unrolled into rings (so-called coils) in the case of wire, is dipped into an acid bath (lowering the pH to roughly 1) and subsequently watered (up to a pH value of roughly 6 to 7). This is typically followed by an additional neutralization in lime bath; a lubricant carrier layer is also formed by this so-called liming. Alternatively, this lubricant carrier layer can also be formed by phosphating (cf. Lueger, vol. 8, p. 546). The lubricant carrier layer (bottom filler) fills in the troughs of the rough material surface and thus serves to anchor a subsequently applied actual separating lubricant. In wire drawing, this is now generally a solid lubricant based on soap, particularly a metallic soap, such as lithium stearate (so-called "dry drawing," cf. Lueger, vol. 8, p. 124). In each drawing process, the wire is pulled through a drawing die of hard metal or diamond and is thereby reduced in diameter and elongated (plastic, essentially noncutting formation). In front of the drawing die is a container in which the solid lubricant is present, and the wire passes through this lubricant powder, continually entraining particles which then form a "lubricating film" in the drawing die.

In this known process, the high cost of pretreatment is a serious disadvantage. Particularly the "wet chemical process"—degreasing, pickling, passivation, wet coating (liming/phosphating)—leads to high operating costs as well as increasingly high disposal cost of the acids and neutralization and/or lime/phosphate sludges.

The present invention is therefore based on the objective of reducing the expense for the application of a lubricant carrier layer and preferably also for the required material pretreatment, but guaranteeing at the same time an at least uniformly good separating lubrication during the subsequent cold forming process. In particular, it is even intended to increase productivity by improved lubricating properties.

According to the invention, this is achieved by a novel dry coating process where, for the formation of the lubricant carrier layer, an equally novel dry carrier material is used, that is, a carrier material present in the "dry phase," not dissolved in water or some other solvent, is applied in the cold state (roughly, ordinary room temperature). This preferably powdered or granular dry carrier material is preferably applied mechanically by pressing or squeezing. The otherwise necessary wet chemical processes are therefore unnecessary.

The dry carrier material according to the invention consists of a preferably powdered or granular dry formulation which contains as its "reactive component" a soap component, in particular a metallic soap and, preferably, certain fillers as "nonreactive component." The preferred "nonreactive component" (fillers) produces a good adhesion to the material surface by filling out unevenness due to its small particle size, and thus acts as an adhesion basis of adhesion promoter. Depending on the amount of its constituents containing dry substance, the "reactive component" may already bring about a sufficient lubrication for the subsequent forming process, so that an additional lubricant may be quite unnecessary. Preferably, however, an "actual lubricant" is added, which may be a known solid lubricant with metallic soap constituents. The soap constituents of the dry carrier material according to the invention and of the dry lubricant then react with one another, particularly by pH value equalization, such that a good adhesion of the dry lubricant over the lubricant carrier layer produced according to the invention is obtained.

A special device for applying the novel dry carrier material as lubricant carrier layer has, according to the invention, "dry coating containers" for housing a number of loose pressing elements as well as an undetermined amount of the dry carrier material, where in order to form the lubricant carrier layer of material, arranged at least partly inside the container, pressing elements surrounding the material can be put into motion such that they mechanically squeeze, rub or press the dry carrier material contained between them onto the surface of the material by uniform physical contact moving over the material surface. The quite small particles of the dry substance are firmly pressed in this process into the existing material roughness. The device may have a screw, injector or dry dipping system; a preferred embodiment of the device according to the invention will be described in greater detail in the description of the figures. By virtue of the invention, the coating can be performed extraordinarily simply and economically. The dry carrier material need only be added into pressing elements in the container. Then it is only necessary to see to it that a sufficient "reservoir" is always present; that is, only the amount of the dry carrier material that has been consumed need be added in each case. A disposal or complete emptying is advantageously no longer needed.

The pressing elements themselves can advantageously be made of the dry carrier material if this consists of relatively large particles or particles in granular or pellet form. In this case, different forms and/or sizes are preferably combined such that a coarse portion and a fine portion results, with the coarse portion serving as the pressing elements and simultaneously being ground up into finer particles, which are then pressed mechanically onto the material surface by the larger particles. The fine portion thus comes into being almost "on its own," so that essentially only the coarse portion need be refilled.

Now, in connection with the invention, it is additionally advantageous if the obligatory prior descaling, that is, the removal of the oxide layer, is also done in a dry process. For this purpose, a device quite similar to the coating device according to the invention is provided, having a container for accommodating a number of loose, stably-shaped grinding elements that surround the material arranged at least in some areas inside the containers and can be put into motion such that they mechanically remove the scale layer by uniform physical contact over the material surface. In a special application for drawing wire, it is of special advantage here that the wire can be processed in a straight-line continuous process in the direction of tension, so that no unpredicted or undefined elongation of the wire occurs thereby.

Advantageous refinements and special embodiments of the invention are contained in the description below.

The invention will be described in greater detail below on the basis of the drawing. The special application case of the invention to "wire drawing" is dealt with there for the sake of example, but without thereby limiting the invention. Instead, the basic measures according to the invention can also be applied to other forming processes, such as tube drawing, deep drawing and cold rolling.

The drawings show in

Figure 2:
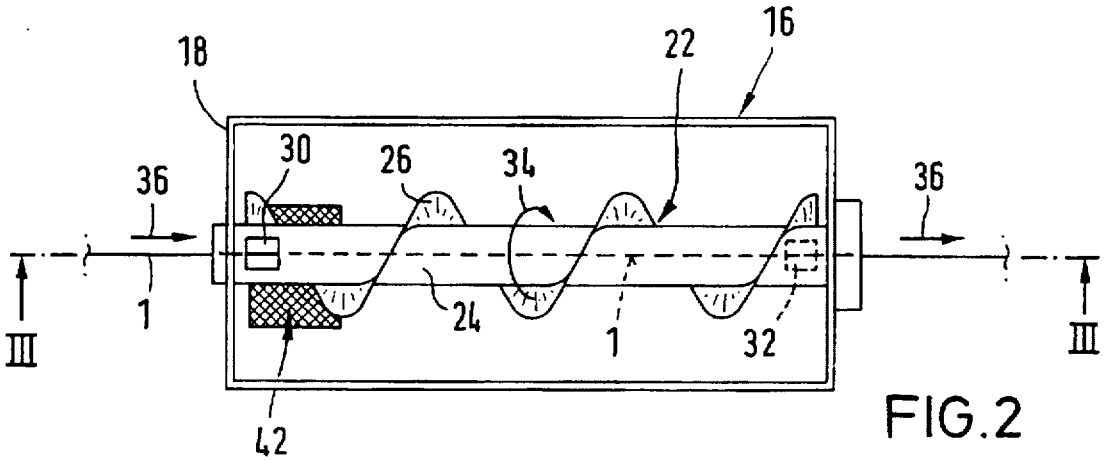
Figure 3:
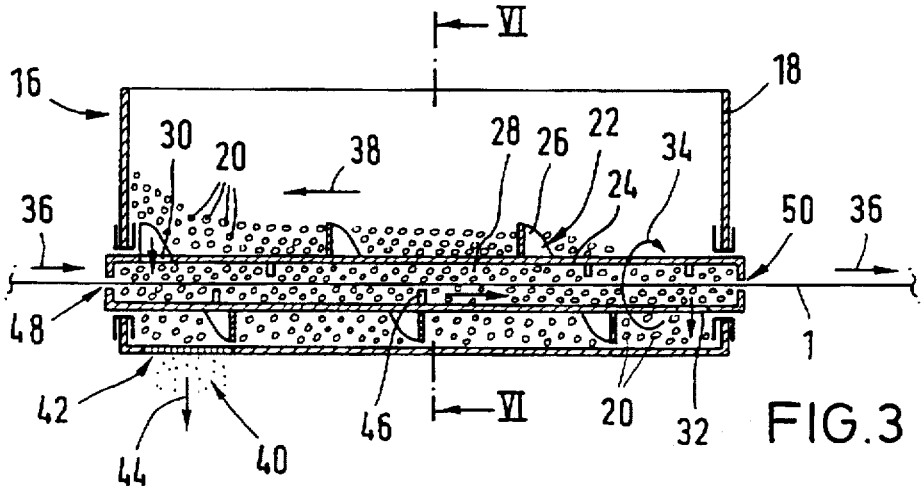
Figure 4:
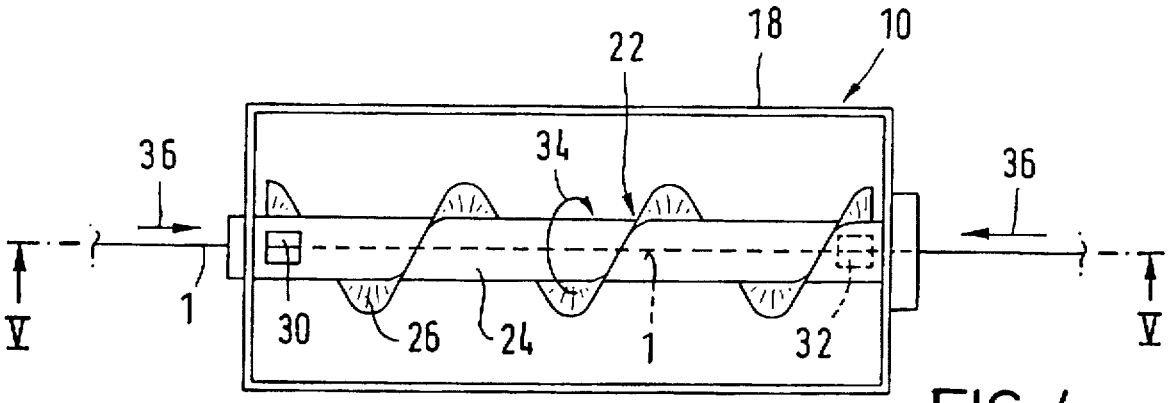
Figure 5:
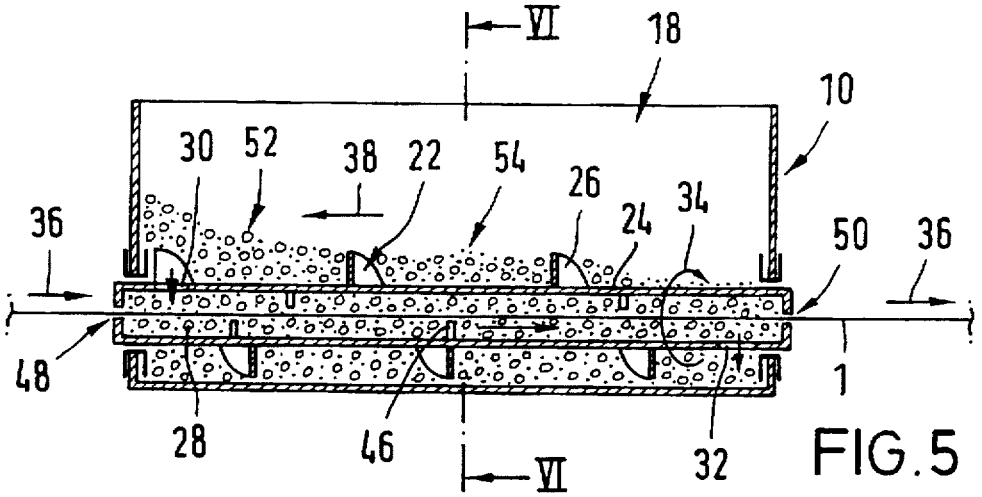
Figure 6:
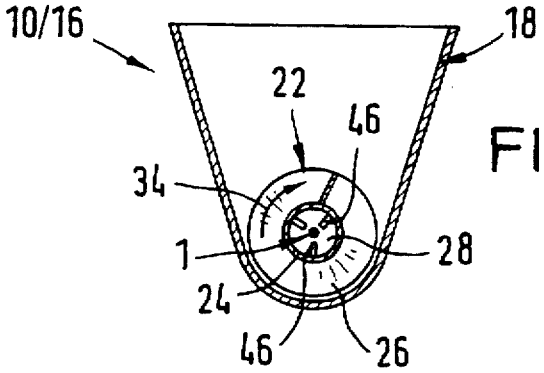

FIG. 1 a highly schematic view of the basic principles of a wire drawing unit with components according to the invention;

FIG. 2 a plan view in the direction of arrow II of FIG. 1 of a "descaling device" according to the invention;

FIG. 3 a longitudinal vertical section through the descaling device in the section plane III—III of FIG. 2;

FIG. 4 a plan view in the direction of arrow IV of FIG. 1 of a "dry coating device" according to the invention;

FIG. 5 a longitudinal vertical section through the coating device in the section plane V—V of FIG. 4;

FIG. 6 a transverse vertical section through the descaling or coating device in the section plane VI—VI of FIG. 3 or 5.

In the various figures in the drawing identical parts are always given the same reference numerals. Any description of a part with reference to one of the figures in the drawing therefore also applies analogously to the other figures in the drawing, in which this part can be seen with the same reference numeral.

According to FIG. 1, wire material 1 preformed by warm rolling is cold-formed continuously in a so-called drawing process, for which it is successively pulled through at least one drawing station 2, but normally through several drawing stations in succession. Each drawing station 2 consists in conventional manner of a drawing die 4 (drawing matrix, particularly one made of diamond or hard metal) and, placed in front of the latter, a lubricant container 6 in which there is a solid lubricant, particularly a powdered one based on metallic soap, through which the wire material 1 is drawn such that the lubricant particles adhere to the wire and are entrained in the direction of arrow 7 into the drawing die 4 and form a separating lubricant film there.

In order to improve the adhesion of the solid lubricant to material 1, a prior descaling (removal of a superficial oxide layer) is performed on the one hand, and on the other, a lubricant carrier layer is formed after descaling on the surface of the wire material 1 in a coating device 10 according to the invention; according to the invention, this is done in a novel dry coating process, which will be discussed further below.

Specifically, the descaling of the wire material 1 is done mechanically (dry descaling) and may be performed in a conventional flexural descaling device 12 by bending the wire material 1 several times over deflection rolls or cylinders 14. Additionally, but preferably as an alternative to the conventional flexural descaling device 12 (which is why it is shown in brackets in FIG. 1), a novel "linear descaling device" 16 is provided according to the invention.

This descaling device 16 according to the invention will now be described further based on FIGS. 2, 3 and 6. It possesses a tub-like container 18 for housing a number of loose grinding elements 20 (drawn in only in FIG. 3) which surround the material 1 present at least in parts of the container 18 and can be set in motion such that they mechanically remove the scale layer by uniform physical contact (mechanical pressure, impact and/or friction) over the material surface. In order to keep the grinding bodies 20 in motion, a conveyor screw that can be driven rotationally is preferably housed inside the container 18. This conveyor screw 22 consists of a screw shaft 24 and a spiral, ridge-shaped screw flight 26 winding around this shaft. As can be seen from the sectional view in FIG. 6, the screw flight 26 has a cylindrical outer surface in the axial projection, and the bottom of the container 18 is bulged in a correspondingly concave shape such that the screw flight 26 is spaced away from the container bottom by a circumferential gap. The screw shaft, arranged, in particular, roughly horizontally, has an axial processing channel 28 for passing through the wire material 1. Thus, the screw shaft 24 is practically tubular. In each of its two end sections lying inside the container 18, the screw shaft 24 has a radial passage opening 30, 32 for the grinding elements 20, with the conveyor screw 22 being driven in the direction of arrow 34, depending on its screw thread direction, such that the grinding elements 20 are moved in a cycle—see particularly FIG. 3—outside of the processing channel 28 and the screw shaft 24 in the container 18 in a direction (arrow 38) opposite to the drawing direction of the wire material 1 (arrow 38), then through the first passage opening 30 inward into the processing channel 28 and is entrained there in the drawing direction 36, being entrained primarily by the wire material 1 moving in this direction and in the meantime removing the scale layer and thereby forming scale particles 40. In the end section of the processing channel 28, the grinding elements 20 and scale particles 40 then escape from the processing channel 28, particularly due to the force of gravity, through the second passage opening 32 of the screw shaft 24 back into the area of the container 18 surrounding the conveyor screw 22. Here the grinding elements 20 are again moved in the direction of arrow 38, and so forth. In order to remove the scale particles 40 contained between the grinding elements 20 from the container 18, it is practical for the container 18 to have sieve openings 42 in its lower area, that is, at its bottom, such that scale particles 40 that have been formed fall out of the container under the effect of gravity (see arrow 44 in FIG. 3), while the grinding elements 20 are maintained in circulation in the container 18. In order to intensify the movements of the grinding elements 20 inside the processing channel 28, it is particularly advantageous if projections 46 pointing inwards in the direction of the wire material 1, preferably running in the center, are provide for mixing and swirling the grinding elements 20. It is practical for these projections 46 to be arranged in a uniform distribution over the length and circumference of the processing channel 28. The projections 46 are preferably arranged radially and may be constituted by pins or rivets that are inserted into the wall of the hollow screw shaft 24 and fastened there. Additionally or alternatively to the projections 46, it is also possible for areas of narrowed cross section (not illustrated) to be formed over the length of the inside of the processing channel 28, in order to generate a pressure on the wire material 1 by means of the grinding elements 20. For guiding the wire material 1 through the processing channel 28, there is on the one hand, an axial wire inlet opening 48 leading into the container 18 and the processing channel 28, and on the other hand, an axial wire outlet opening 50 leading out of the processing channel 28 and the container 18 to the outside, with the inlet opening 48 and the outlet opening 50 preferably having a slightly larger diameter than the wire material 1, in order to make a practically friction-free relative motion possible. In the vicinity of the outlet opening 50, it is advantageous to provide a stripper (not illustrated) to hold back the scale particles 40, which wipes off or cleans the wire material 1. The grinding elements 20 provided according to the invention are at least approximately spherical and consist of a relatively hard material of stable shape, particularly made of ceramic material or steel. Particularly suitable is magnesium silicate or aluminum oxide. The diameter of the grinding elements 20 preferably lies in the range of 3–25 mm.

The dry coating device 10 briefly mentioned above will be explained in more detail based on FIGS. 4–6. The preferred embodiment illustrated this device 10 corresponds in principle and design to the descaling device 16 according to the invention, so that reference can be made to the description in that regard with respect to further details, with identical parts always being provided with the same reference numerals. Below there will be a detailed discussion only of special differences. Thus, the container 18 of the coating device 10 serves to accommodate a number of loose pressure particles 52 which may in principle correspond to the grinding elements 20 of the descaling device 12 and/or may be formed of larger particles (pellets) of a special dry carrier material 54. A defined amount of this special dry carrier material 54 is poured into the container 18 in powdered or granular form, possibly with the addition of the dimensionally stable pressure elements 52. Here too, the loose pressure elements 52 can be set in motion inside the container 18 such that they mechanically apply the finer-grained dry carrier material 54 contained between them as a lubricant carrier layer to the surface of the material 1 by means of uniform physical contact over the material surface. In practical terms, this is a pressing, squeezing, rolling or rubbing on [of material], by which, in any case, the particles are pressed into the surface depressions of the material 1. Here, too, the movement of the pressure elements 52 is produced essentially by the conveyor screw 22. This implies that the pressure elements 52 move outside the processing channel 28 along with the smaller particles of the dry carrier material 54 contained between them in the container 18 in a direction 38 opposite the drawing direction 36, then through the first passage opening 30 into the processing channel 28, are entrained there by the wire material 1 in the drawing direction 36, forming the lubricant carrier layer in the process, as well as again exiting the processing channel 28 in its end section through the second passage opening 32. This cycle continually repeats itself. The motion of the pressure elements 52 inside the processing channel 28 is once again intensified by the projections 46 and/or the portions of narrowed cross section. It is advantageous that in the continual movement of the pressure elements 52 the dry carrier material 54 is rubbed or ground down to a very fine consistency; the resulting extremely fine particles adhere particularly well in the fine depressions of the surface structure of the material 1. Here too, the wire inlet opening 48 has a slightly larger diameter than the wire material 1 in order to guarantee a friction-free or low-friction motion. By contrast, the outlet opening 50 is preferably adapted in diameter to the wire material 1 and the desired layer thickness such that the desired layer thickness of the lubricant carrier layer is set by stripping off a part of the lubricant carrier layer, which was actually "thicker" inside the processing channel 28. With regard to material and size, the pressure elements 52 may correspond to the grinding elements 20 of the descaling device 16 and/or at least part of the pressure elements are then constituted by the granular or pellet-shaped dry carrier material 54 itself. It should also be mentioned that the container 18 of the coating device 10 is of course closed in its lower tub-like area, i.e., it has no sieve openings or the like as are found in the descaling device 16.

It is advantageous for the processing steps according to the invention, "descaling" and/or "dry coating," to be performed immediately during the actual wire drawing process; i.e., the coating device 10 and/or the descaling device 16 according to the invention are arranged upstream of the first drawing station 2. This allows productivity to be influenced very favorably.

In connection with the invention, it is preferable to use a dry carrier material 54 which consists, in particular, of a powdered or granular dry formula that preferably contains fillers and a soap component, in defined proportions. The fillers primarily bring about an adhesion to the material 1 and, for this purpose, consist preferably of at least portions of metal oxides or metal salts. The soap component preferably consists of a metallic soap or a mixture of several (e.g., two) metallic soaps and produces an adhesion basis for a dry lubricant to be applied subsequently in the drawing station 2 by having the soap components react with one another. The dry formula according to the invention preferably contains a relatively high filler content of, specifically, 70–98 wt % and a relatively low soap content of, specifically, 2–30 wt %. A dry lubricant on a soap basis with a high soap content and a low filter content can preferably be used in connection with this. According to the invention, therefor, this is a "displacement" of the fillers creating adhesion into the dry carrier material according to the invention. The low soap content of the dry carrier material serves only as a binding component to the solid lubricant. It can also be provided according to the invention, however, that the dry carrier material already has sufficient lubricating properties, due to a higher soap content, so that it is possible to forgo a subsequently applied solid lubricant.

There are naturally a number of various possibilities for the dry formula according to the invention. Several particularly advantageous dry formulas will be described below for the sake of example:

A.
- Fillers
  - roughly 38 wt % titanium dioxide
  - roughly 38 wt % lithium phosphate and
  - roughly 15 wt % magnesium oxide, as well as
- Soap Component
  - roughly 9 wt % zinc stearate B. Dry formulas with potassium soap content
- B.1 roughly 23 wt % potash (potassium carbonate)
  - roughly 45 wt % fatty acid
  - roughly 6 wt % titanium dioxide
  - roughly 26 wt % carbonate
- B.2 roughly 25 wt % potash (potassium carbonate)
  - roughly 70 wt % fatty acid
  - roughly 5 wt % fatty alcohol Potassium soaps have particular advantages in the sense that a fast and simple cleaning of lubricants is desired today for the final material. A water-soluble lubricant layer can advantageously be achieved with potassium soap components. Furthermore, a dry carrier material based on potassium-soap components has the following advantages with respect to calcium and sodium soap components:

1. more uniform coating of the material to be formed by better surface adhesion,
2. greater stability due to a higher melting point of the potassium soaps.

Therefore, very low filler contents suffice, and a filler component may possibly be completely superfluous. Nonetheless, a higher formability of the material can be achieved with the possibility of fast and simple cleaning of the formed material (in contrast to dry carrier materials with soap and filler contents, based, for instance on Ca, Na or lithium).

3. a dry carrier material with potassium soap content is advantageously suited to being able to do without a solid lubricant in the subsequent drawing process and nevertheless produces good lubricating properties, particularly if the potassium soap content exceeds 70%.
4. it is advantageous that materials coated with potassium soap dry carrier material can also be processed very well in a subsequent wet forming or wet drawing process without requiring an additional lubricating component. The dry-coated material need only be struck with water, which immediately results in a surface capable of forming work in terms of lubricant technology, specifically by emulsion or dispersion, depending on the exact dry formula. The following surprising advantage also appears here, namely that the adhesive properties of the formed material or wire to other materials such as rubber are very positively affected. This constitutes an essential advantage, for instance, for the tire industry, where steel wires are bonded to rubber (steel cord—tirecord wire).

C. Dry Formulas on a Synthetic Basis or Wax Basis such formulas are applied where the greatest insolubility of the coating is essential, for sealing the surface, for instance (so-called separation lubrication). A compound or reaction of the dry support with a solid lubricant or liquid lubricant (including mineral oil) or water does not occur.

The sequence of the process according to the invention for applying the lubricant carrier layer, preferably with previous descaling, should have become sufficiently clear from the description above such that further explanations of it are probably unnecessary.

The descaling device 16 is not limited to use in or before the coating process according to the invention, but can also be employed independently, that is, separately from a cold-forming process for removing an oxide layer or similar surface layer, perhaps before a subsequent painting process or the like.

Furthermore, the coating device 10 can in principle be used for an type of dry coating, that is, not only for applying lubricants or lubricant carrier layers, but for instance, also for forming corrosion protection layers of similar coatings that can be applied dry. Then, instead of the dry carrier material according to the invention, a different coating material is added in dry form (powdered or as granular material) to the pressure elements and or as pressure element in container 18.

The device 10 or 16 is therefor in general terms a "device for applying a surface layer to or removing it from a material, in particular a wire material in a continuous run," which can also be employed independently of the special application in cold forming processes.

The invention is therefore not limited to the concretely illustrated embodiment and application example, but comprises all embodiments, variants and applications functioning in a manner equivalent to the invention. The invention is also by no means limited to the features contained in each of the independent claims, but may also be defined by any other arbitrary combination of the individual characteristics disclosed in the application. This implies that practically any individual characteristic of any independent claim can be omitted or replaced by any individual characteristic disclosed elsewhere in the application. In that sense, the claims up to this point are to be understood merely as a first attempt to formulate an invention.

I claim:

1. Apparatus for application of a lubricant carrier layer to a bare metal surface of a wire material (1) to be formed in a drawing process wherein a carrier material in the dry phase is applied on the surface to form the lubricant carrier layer, comprising;

a container (18) surrounding a part of the wire material (1) and receiving a number of loose pressure elements (52) as well as a defined amount of a dry carrier material (54) characterized by a filler and a soap component, and;

means for setting in motion the pressure elements (52) surrounding the wire material (1) whereby the pressure elements mechanically apply the dry carrier material (54) contained in the form of smaller particles between the pressure elements by uniform physical contacts moving over the bare metal surface of the wire material (1), so as to form the lubricant carrier layer on the bare metal surface of the wire material.

2. Apparatus according to claim 1, wherein:

a conveyor screw (22) operative for being driven in rotation is arranged inside the container (18), the screw shaft (24) of which has an axial processing channel (28) for guiding the wire material (1);

the screw shaft (24) has passage openings (30, 32) in its two end areas lying inside the container (18) for the pressure elements (52) and the dry carrier material (54) contained between the pressure elements, and;

the conveyor screw (22) is driven depending on its screw thread direction such that the pressure elements (52) and the dry carrier material (54) contained between them are moved in a cycle outside the processing channel (28) in the container (18) in a direction (38) opposite to the drawing direction (36) of the wire material (1), through the first passage opening (30) into the processing channel (28), from there in the drawing direction (36) while forming the lubricant carrier layer, as well as at the terminal area of the processing channel (28), back out of the processing channel via the second passage opening (32).

3. Apparatus according to claim 2, wherein:

inside the processing channel (28), projections (46) pointing inward in the direction of the wire material (1) and running in the center or narrowed cross sections are provided in a uniform distribution over the length and circumference of the processing channel (28), for mixing and swirling the pressure elements (52) and the dry carrier material (54).

4. Apparatus according to claim 2, further comprising:

an axial wire inlet opening (48) into the container (18) and the processing channel (28) and an axial wire outlet opening (50) leading out of the container (18) and the processing channel (28) to the outside;

the inlet opening (48) having a slightly larger cross section than the wire material (1), and;

the outlet opening (50) being defined in its cross section relative to the wire material (1) and the desired layer thickness of the lubricant carrier layer such that the desired layer thickness is set by stripping off a part of the lubricant carrier layer.

5. Apparatus according to claim 1, wherein:

at least part of the, pressure elements (52) are at least approximately spherical and consist essentially of ceramic material, magnesium silicate, aluminum oxide, or steel.

6. Device according to claim 1, characterized in that at least a part of the pressure elements (52) is formed of relatively large particles of the dry carrier material (54) shaped in granular or pellet-form for this purpose.

7. Process for applying a dry lubricant to a wire material to be formed in a drawing process, comprising the steps of:

applying to a bare metal surface of the wire material a layer of a special lubricant carrier material in the dry phase, said dry carrier material consisting essentially of a soap component and fillers;

subsequently applying onto the lubricant carrier layer a conventional solid dry soap lubricant; and composing the soap component and fillers of the special lubricant carrier material so that the soap constituents of the lubricant carrier material and of the dry lubricant react with one another by pH-value equalization so as to obtain an improved adhesion of the dry lubricant over the lubricant carrier layer.

8. Process according to claim 7, characterized in that the dry carrier material is powdered or granular and is applied mechanically by pressing, rubbing, or squeezing.

9. Process according to claim 7, characterized in that the dry carrier material is applied by a number of spherical pressure elements (52) by setting the dry carrier material (54) present in the form of smaller particles between the pressure elements (52), together with the pressure elements (52) surrounding the material (1) to be coated, into motion to apply pressure to the surface of the material (1).

10. Process according to claim 7, characterized in that the wire material (1) is provided with the lubricant carrier layer in a continuous run.

11. Process according to claim 7, characterized in that the lubricant carrier layer is first applied at a thickness greater than the desired layer thickness and is then reduced to the desired layer thickness by drawing the wire material (1) through an appropriately formed outlet opening (50).

12. Process according to claim 7, characterized in that the content of the fillers is higher than the contents of the soap.

13. Process according to claim 7, characterized in that material to be coated (1) is mechanically descaled before the application of the lubricant carrier layer.

14. Process according to claim 13, characterized in that the descaling is done by an at least double bending process of the wire material (1) in a continuous run.

15. Process according to claim 13, characterized in that the descaling is done by uniform subjection of the material (1) to mechanical friction, pressure or impact by means of a number of roughly spherical grinding elements (20) in a continuous straight-line run of the wire material (1).

16. Dry carrier material for application as a lubricant carrier layer to a bare metal surface of a wire material to be formed in a drawing process, said dry carrier material containing fillers and a soap component of the following composition:

roughly 23 wt % potassium carbonate;

roughly 45 wt % fatty acid;

roughly 6 wt % titanium dioxide; and roughly 26 wt % carbonate.

17. Dry carrier material according to claim 16, characterized in that the dry formula is constructed in powdered or granular form.

18. Dry carrier material for application as a lubricant carrier layer to a bare metal surface of a wire material to be formed in a drawing process, said dry carrier material containing fillers and a soap component of the following composition:

roughly 25 wt % potassium carbonate;

roughly 70 wt % fatty acid; and roughly 5 wt % fatty alcohol.

19. The dry carrier material according to claim 18, whereby the carrier material is in powdered or granular form.

* * * * *